US009048043B2

(12) United States Patent
Specht et al.

(10) Patent No.: US 9,048,043 B2
(45) **Date of Patent: *Jun. 2, 2015**

(54) PUSH BUTTON SWITCH ASSEMBLY

(75) Inventors: Trevor Specht, Ansbach (DE); Heiko Meissner, Ansbach (DE)

(73) Assignee: ELECTROLUX HOME PRODUCTS CORPORATION N.V., Brussels (BE)

( * ) Notice: Subject to any disclaimer, the term of this patent is extended or adjusted under 35 U.S.C. 154(b) by 340 days.

This patent is subject to a terminal disclaimer.

(21) Appl. No.: 13/376,860

(22) PCT Filed: Jul. 12, 2010

(86) PCT No.: PCT/EP2010/004216

§ 371 (c)(1),
(2), (4) Date: Mar. 12, 2012

(87) PCT Pub. No.: WO2011/012219

PCT Pub. Date: Feb. 3, 2011

(65) Prior Publication Data

US 2012/0152712 A1 Jun. 21, 2012

(30) Foreign Application Priority Data

| | | |
|---|---|---|
| Jul. 29, 2009 | (DE) | 20 2009 010 291 U |
| Jul. 29, 2009 | (DE) | 20 2009 010 292 U |
| Mar. 25, 2010 | (EP) | 10003182 |

(51) Int. Cl.

| | |
|---|---|
| ***H01H 13/50*** | (2006.01) |
| ***H01H 13/705*** | (2006.01) |
| *H01H 13/52* | (2006.01) |

(52) U.S. Cl.

CPC ..... *H01H 13/705* (2013.01); *H01H 13/52* (2013.01); *H01H 2221/044* (2013.01); *H01H 2221/058* (2013.01); *H01H 2221/062* (2013.01); *H01H 2221/074* (2013.01)

(58) Field of Classification Search

USPC ..... 200/341

See application file for complete search history.

(56) References Cited

U.S. PATENT DOCUMENTS

2012/0111705 A1* 5/2012 Specht et al. ..... 200/344

FOREIGN PATENT DOCUMENTS

| | | |
|---|---|---|
| DE | 9111790 | 1/1992 |
| DE | 10309516 | 11/2004 |
| EP | 0798753 | 10/1997 |
| EP | 1113101 | 7/2001 |
| WO | 2004057135 | 7/2004 |

OTHER PUBLICATIONS

International Search Report for PCT/EP2010/004216, dated Sep. 2, 2010, 3 pages.

* cited by examiner

*Primary Examiner* — Renee Luebke
*Assistant Examiner* — Ahmed Saeed
(74) *Attorney, Agent, or Firm* — Pearne & Gordon LLP

(57) ABSTRACT

Push button switch assembly for insertion in a control panel of a domestic appliance, the push button switch assembly comprising at least one push button having a push button cap and a separately formed actuating element, in particular an actuating pin, which extends between the push button cap and an electric switching element of the domestic appliance and upon actuating of the push button cap cooperates therewith and acts on the electric switching element to effect a switching operation, and a frame receiving and guiding the at least one push button cap, wherein at least one spring leg is arranged at the actuating element, which counteracts the actuating of the push button cap.

14 Claims, 7 Drawing Sheets

PUSH BUTTON SWITCH ASSEMBLY

The present invention relates to a push button switch assembly for insertion in a control panel of a domestic appliance, the push button switch assembly comprising at least one push button having a push button cap and a separately formed actuating element, in particular an actuating pin, which extends between the push button cap and an electric switching element of the domestic appliance and upon actuating of the push button cap cooperates therewith and acts on the electric switching element to effect a switching operation, and a frame receiving and guiding the at least one push button cap.

Control panels of domestic appliances normally comprise a plurality of different operational controls for setting specific functions, for example push buttons or the like. Such push buttons may be arranged separately or side by side in order to define a push button panel. It is important, that the functional units are spatially adjusted to one another such that the push buttons arranged at the operating panel and the electric switching elements positioned underneath the control panel cooperate without any problems.

One known push button switch assembly is described in EP-A-1 482 527. This push button switch assembly comprises several push buttons each having a push button cap and an actuating element in the form of an actuating pin, whereas the push button cap and the actuating element are formed as a one-piece component. The actuating elements extend from the assigned push button cap towards an electric switching element of the domestic appliance in order to effect a switching operation upon actuation of the push button cap. The push buttons are received and guided by a frame, which in turn is fixed to the control panel of the appliance. In order to move the push buttons back in their initial position after actuation, each actuation element cooperates with a silicon mat with carbon pill, which generates the necessary restoring force.

One drawback of the one-piece design of the push buttons of the push button switch assembly according to EP-A-1482527 is that sink marks are created on the visual surface of the push button caps during their manufacture. This is not desirable for optical reasons. Moreover, manufacturing tolerances of the control panel, the push buttons, the frame or the switching elements cannot be compensated without difficulty. In particular control panels made of glass go along with large manufacturing tolerances, because no precise and at the same time competitive low cost glass machining techniques are available at present.

In order to overcome the mentioned drawbacks, EP-A-1467390 proposes to provide the push button cap and the actuating element of each push button as separate components. By means of this physical separation unproblematic compensations of shape and position tolerances are possible, which can be traced back to e.g. manufacturing tolerances of the push button switch assembly, the control panel or the electric switching element. The actuating elements can then have a certain play within the frame or the push button cap in the actuating direction or laterally thereto, such that they can also actuate a slightly displaced electric switching element or can be brought into engagement therewith. Moreover, the orientation of the push button caps within the frame is not influenced by the position of the assigned actuating elements. In order to move the push button caps back in their initial position after actuation, each push button cap is formed with two or four spring legs, which rest on the frame and create the necessary restoring force.

However, a two-part design of the push button as proposed in EP-A-1467390 leads to an undefined and alterable position of the actuating element between the frame and the electric switching element. Thus, an accurate and stable position of the actuating element relative to the tactile switches on the electronic board cannot be ensured. Moreover the undefined position of the actuating element can lead to an unwanted rattle.

Starting from this prior art it is an object of the present invention to provide a push button assembly of the above-mentioned kind, which overcomes or reduces the described drawbacks.

This object is solved by providing a push button switch assembly having the features of claim 1.

The push button switch assembly according to the present invention, which is to be inserted in a control panel of a domestic appliance, comprises at least one push button having a push button cap and a separately formed actuating element, in particular an actuating pin, which extends between the push button cap and an electric switching element of the domestic appliance and upon actuating of the push button cap cooperates therewith and acts on the electric switching element to effect a switching operation, and a frame receiving and guiding the at least one push button cap. Due to the fact, that the push button cap and the actuating element are formed as separate components, no sink marks are formed on the visual surface of the push button cap. Moreover, manufacture tolerances can be compensated without any problems. Additionally, the length of the actuating element can be tuned for different electronic switching elements, e.g. electronic boards, and different applications. At least one spring leg is arranged at the actuating element, which counteracts the actuating of the push button cap. Thus, an accurate and stable position of the actuating element relative to the tactile electric switching element is ensured. Accordingly, there will be no rattle. Moreover, the spring force of the at least one spring leg can be tuned in order to vary the push and return forces of the actuating element.

The actuating element advantageously comprises at least two symmetrically and/or uniformly arranged spring legs. By providing a plurality of spring legs, the position stability is improved.

The actuating element can comprise a broadened head portion defining a supporting surface for the bottom side of the push button cap. This also supports the position stability.

The push button cap preferably comprises at least one spring leg, which counteracts the actuating of the push button cap in order to move the push button back in its initial position after an actuation. Moreover, if several push buttons are provided, the at least one spring leg of the push button cap ensures that all push buttons are positioned at the same level when situated in their rest position.

Preferably, a plurality of spring legs are provided at the push button cap, which are arranged in such a manner, that they counteract a tilting of the push button cap out of its plane, in particular out of its rest position plane or out of a plane parallel thereto. This promotes in particular the ease of use.

Advantageously, the push button cap comprises at least three, preferably four, in particular symmetrically and/or uniformly arranged spring legs.

The frame preferably has an inner contour comprising at least one boss and/or at least one rib, which is/are formed corresponding to assigned counter-contours of the at least one push button cap in order to define the position of the push button cap relative to the frame in the rest position of the push button cap and/or in order to guide the push button cap during an actuating of the push button cap relative to the frame. This leads to an exact position and orientation of the push button caps relative to each other and within the frame. Moreover, an easy installation of the push buttons in the frame is promoted.

The frame preferably has an inner contour comprising at least one guiding structure, which is formed corresponding to an associated counter-contour of the at least one actuating element, in order to define the position of the actuating element relative to the frame in the rest-position of the push button cap and/or in order to guide the actuating element during an actuating of the push button cap relative to the frame. Thus, the actuating element does not need to be guided an additional housing or the like.

According to one embodiment of the present invention, the frame has an inner contour limiting an admissible actuating stroke of the actuating element with respect to the switching element of the domestic appliance. Consequently, the loading of the electric switching element is limited, such that a mechanical protection of the electric switching element is provided.

The frame advantageously comprises a preferably circumferential edge, which rests on the side of the control panel facing an operator.

The frame preferably comprises fixing means for fixing the frame at the control panel, in particular in the form of snap arms snapping behind the control panel when the frame is inserted in an opening of the control panel.

According to one embodiment of the present invention the electric switching element of the domestic appliance is a switch arranged on a circuit board, in particular a micro switch.

In the following an embodiment of a push button switch assembly according to the present invention for insertion in a control panel of a domestic appliance will be described with reference to the accompanying drawings, wherein FIG. 1 is a perspective view of an actuating element of the push button switch assembly;

Figure 1:
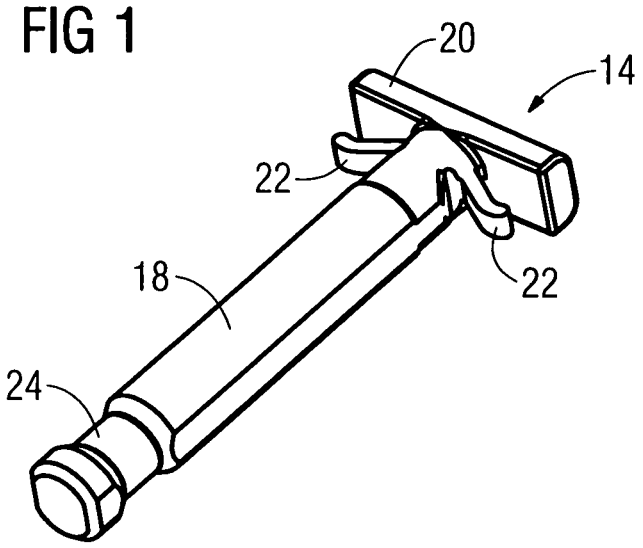
Figure 2:
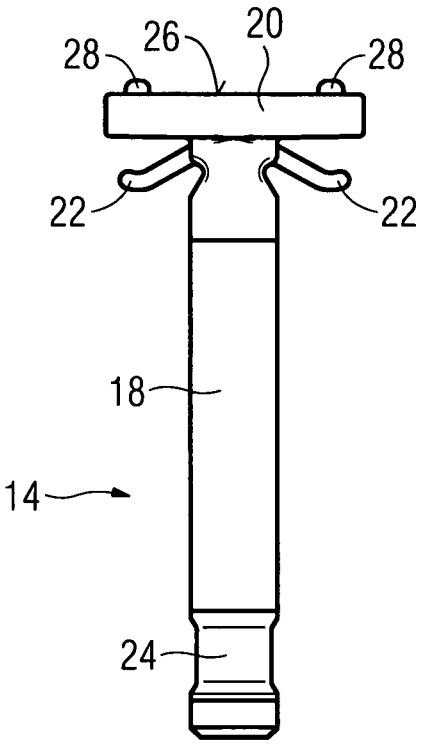
FIG. 2 is a front view of the actuating element.
Figure 3:
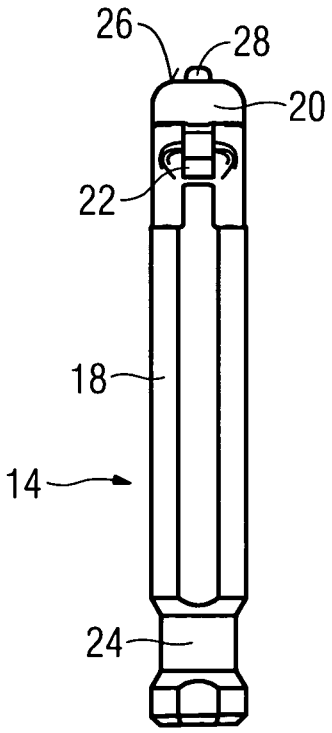
FIG. 3 is a side view of the actuating element.
Figure 4:
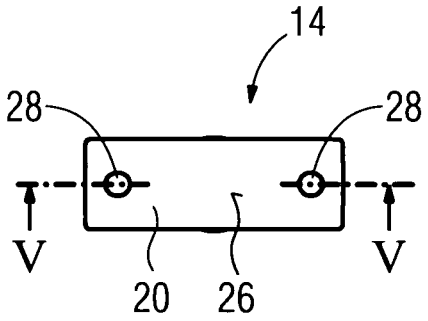
FIG. 4 is a top view of the actuating element.
Figure 5:
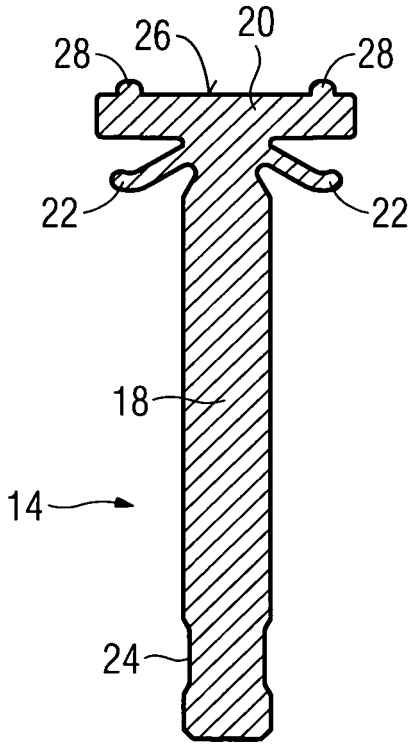
FIG. 5 is a sectional side view of the actuating element along line V-V in FIG. 4.
Figure 6:
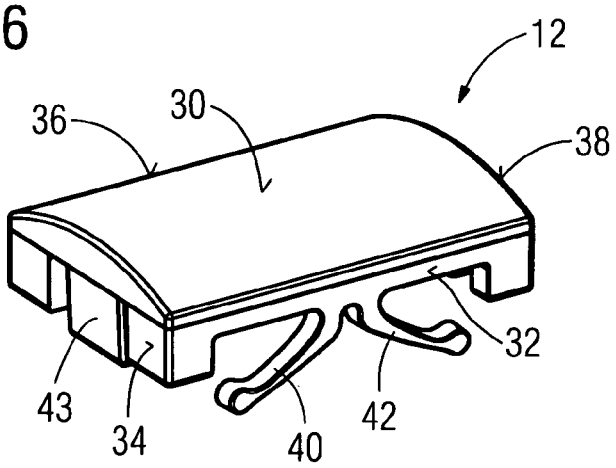
FIG. 6 is a perspective view of a push button cap of the push button switch assembly.
Figure 7:
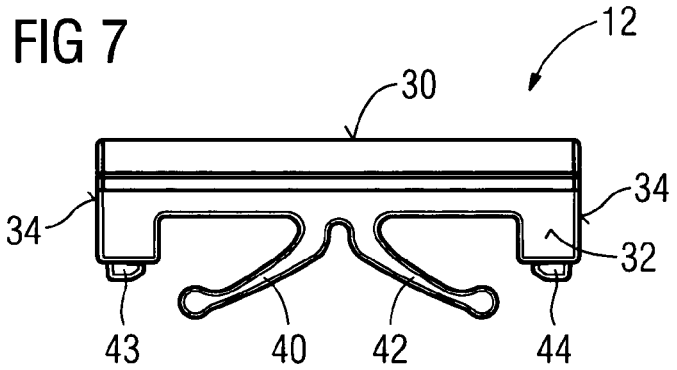
FIG. 7 is a front view of the push button cap.
Figure 8:
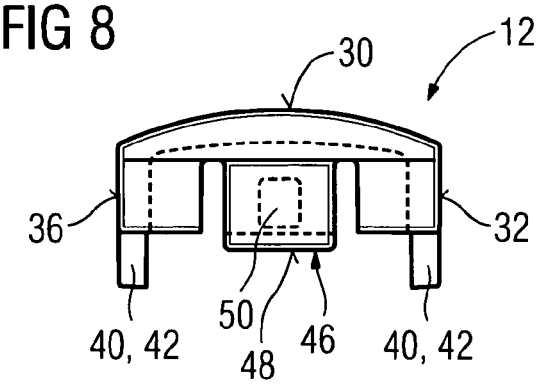
FIG. 8 is a side view of the push button cap, wherein hidden portions are represented by dashed lines.
Figure 9:
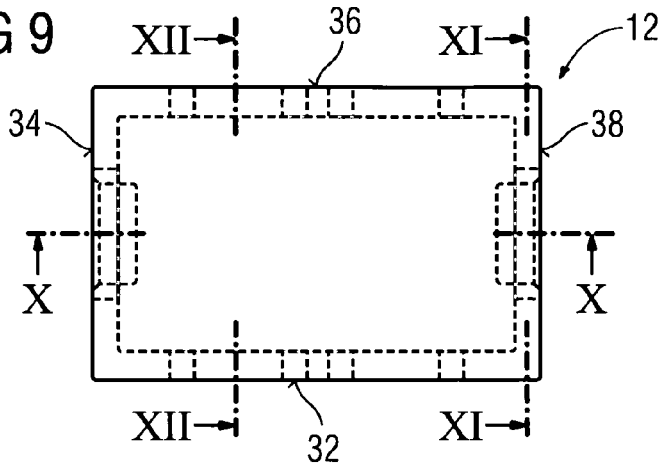
FIG. 9 is a top view of the push button cap, wherein hidden portions are represented by dashed lines.
Figure 10:
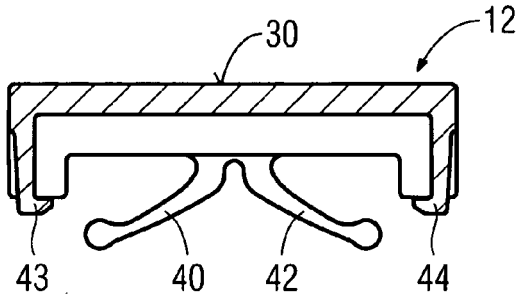
FIG. 10 is a sectional side view of the push button cap along line X-X in FIG. 9.
Figure 11:
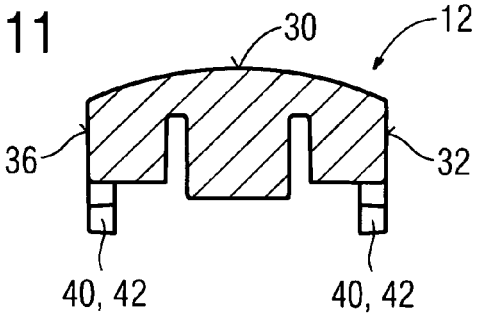
FIG. 11 is a sectional side view of the push button cap along line XI-XI in FIG. 9.
Figure 12:
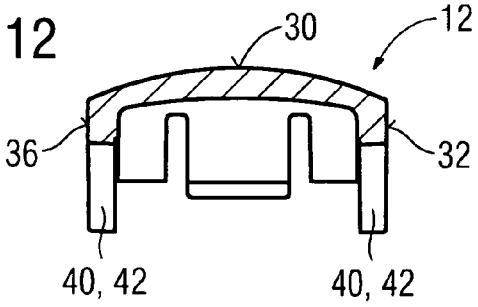
FIG. 12 is a sectional side view of the push button cap along line XII-XII.
Figure 13:
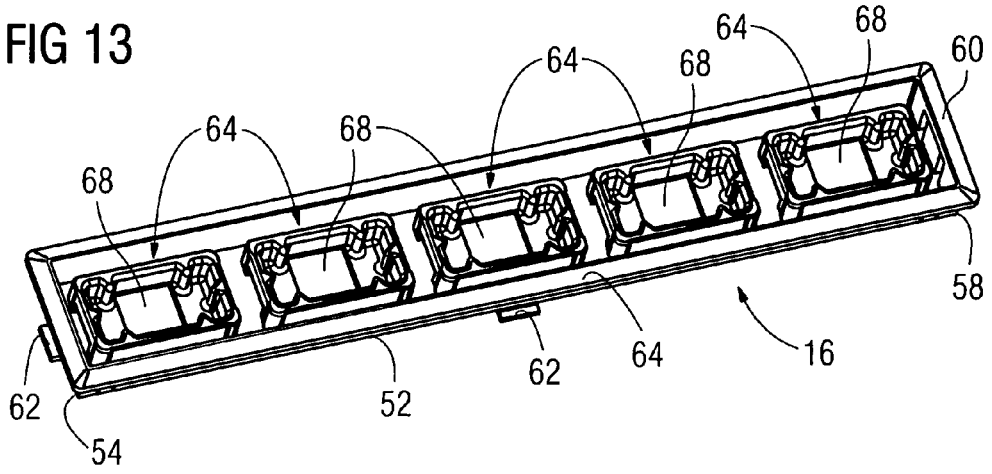
FIG. 13 is a perspective view of a frame of the push button switch assembly.
Figure 14:
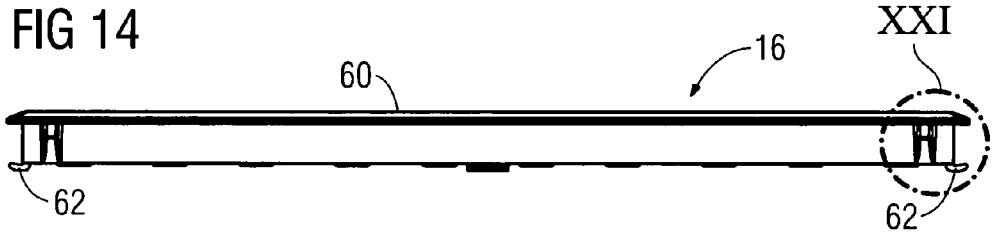
FIG. 14 is a front view of the frame.
Figure 15:
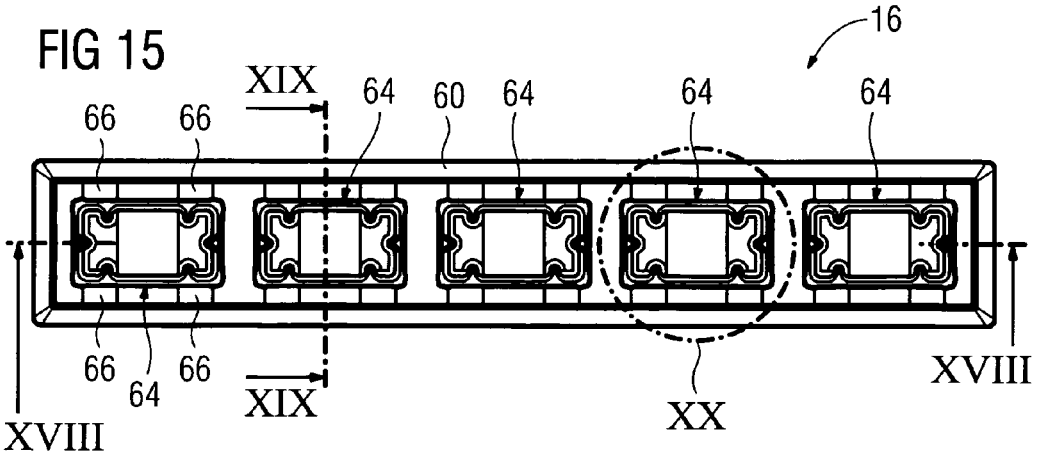
FIG. 15 is a top view of the frame.
Figure 16:
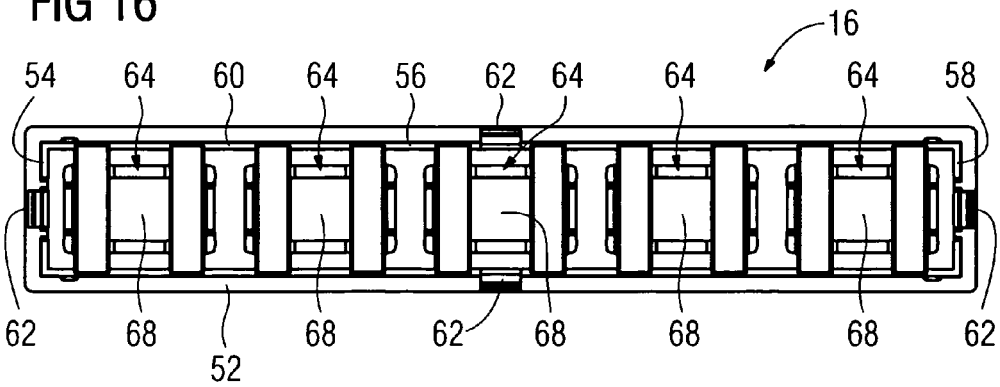
FIG. 16 is a bottom view of the frame.
Figure 17:
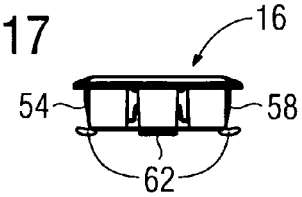
FIG. 17 is a side view of the frame.
Figure 18:
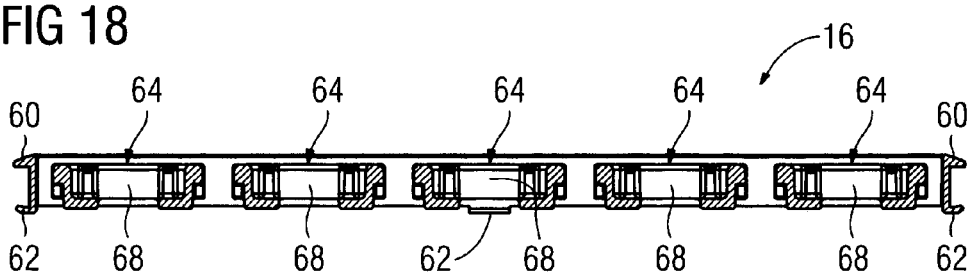
FIG. 18 is a sectional front view along line XVIII-XVIII in FIG. 15.
Figure 19:
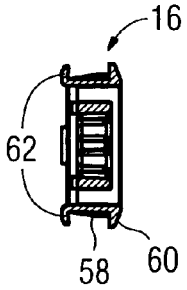
FIG. 19 is a sectional side view of the frame along line XIX-XIX in FIG. 15.
Figure 21:
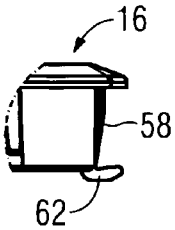
FIG. 21 is an enlarged view of section B in FIG. 14.
Figure 20:
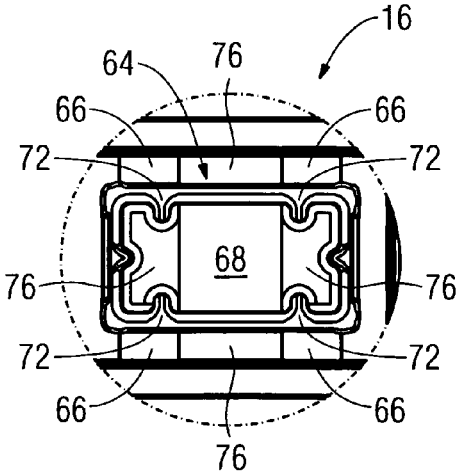
FIG. 20 is an enlarged view of section A in FIG. 15.
Figure 22:
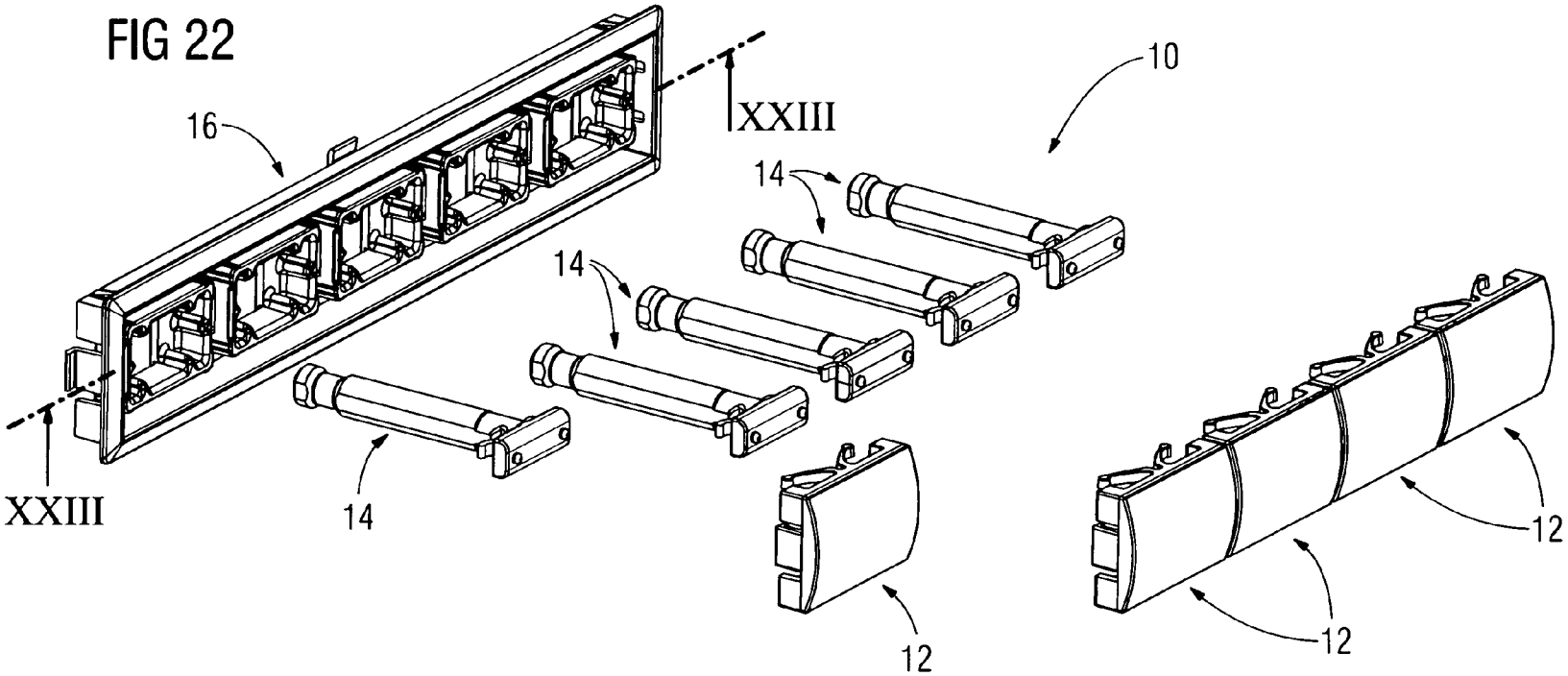
FIG. 22 is a perspective exploded view of the push button switch assembly prior to its assembly and FIG. 23 is a partly broken away sectional front view along line XXIII-XXIII in FIG. 22.
Figure 23:
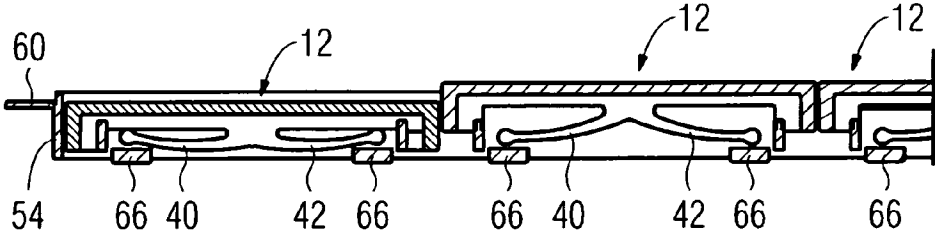

FIGS. 1 to 23 show a push button switch assembly 10 according to the present invention and different views of its components. The push button switch assembly 10 is to be inserted in a control panel (not shown) of a domestic appliance, in particular in a control panel made of glass, metal, plastic or another material having similar characteristics. As main components the push button switch assembly 10 comprises five push buttons, each having a push button cap 12 and a separately formed actuating element 14, and a frame 16 receiving the five push buttons and guiding their movements when manually actuated.

The actuating element 14, which is shown in detail throughout FIGS. 1 to 5, is provided as an actuating pin having a pin portion 18, a head portion 20 and two spring legs 22. The pin portion 18 comprises close to its free end a circumferential groove 24, which may cooperate e.g. with projecting structures of an additional housing (not shown) in order to accurately position and guide the actuating element 14 during its actuating stroke. At its other end the pin portion 18 passes into the laterally extending head portion 20. The head portion 20 defines a supporting surface 26, which cooperates with the bottom side of the push button cap 12 as it is described later. Two pins 28, which improve the orientation between the actuating element 14 and the push button cap 12, project from the supporting surface 26. The two spring legs 22 extend downwardly from the circumference of the pin portion 18 at a position slightly beneath the head portion 20.

The push button cap 12, which is illustrated in detail in FIGS. 6 to 12, comprises a domed top face 30, which is manipulated by the user, and four downwardly extending sidewalls 32, 34, 36 and 38. Two oppositely arranged sidewalls 32 and 36 are each provided with two spring legs 40 and 42. The spring legs 40 and 42 are formed in a middle section of the assigned sidewall and extend diagonally apart in a downward direction within the plane of the assigned sidewall, such that they define an inverted V-form. At each of the other two opposite sidewalls 34 and 38 a snap arm 43, 44 is formed, whereas one snap arm 43 faces the other snap arm 44. In a middle portion of the bottom side of the top face 30 a downwardly protruding projection 46 is formed, whose bottom face 48 cooperates with the supporting surface 26 of the head portion 20 of the actuating element 14. In order to receive the pins 28 projecting from the supporting surface 26, the bottom face 48 of the projection 46 is provided with two corresponding openings 50.

The frame 16, which is shown in detail throughout FIGS. 14 to 21, has a longitudinal shape and is designed to receive five push buttons. The frame 16 comprises four frame sidewalls 52, 54, 56 and 58, which are provided at their upper ends with a circumferential edge 60 resting—when received in an opening of a control panel (not shown)—on the outer side of the control panel. At the lower end of the frame sidewalls 52, 54, 56 and 58 fixing means 62 in the form of snap arms are provided, which snap behind the bottom face of the control panel as soon as the frame 16 is inserted in an opening thereof. The distance between the circumferential edge 60 and the fixing means 62 is chosen in such a manner that a clamping force is created between the frame 16 and the control panel in the inserted state of the frame 16. In the interior of the frame 16, which is defined within the frame sidewalls 52, 54, 56 and 58, five separate and equally spaced receiving frameworks 64 are arranged. Each receiving framework 64 is held between the two opposing longish frame sidewalls 52 and 56 by means of four connecting bars 66. Each receiving framework 64 is to receive an actuating element 14 as well as a push button cap 12. For this purpose each receiving framework 64 comprises an opening 68 for receiving the pin portion 18 of an actuating element 14, two supporting surfaces 70, located at opposite sides of the opening 68 in order to receive the spring legs 22 of an actuating element 14 inserted in the opening 68, and six ribs 72, which are distributed over the inner contour of the receiving framework 64, which are in contact with the outer contour of the head portion 20 of the actuating element 14 in order to receive and guide it. Moreover, each receiving framework 64 is provided at its outer contour at opposite sides with recesses 76 for receiving the snap arms 42 of the push button cap 12.

During the assembly of the push button switch assembly 10, the frame 16 is pushed into an opening of a control panel from above at first, such that the fixing means 62 of the frame 16 snap behind the bottom face of the control panel and the circumferential edge 60 rests on the top face of the control panel. Thereafter, the actuating elements 14 are inserted in the assigned openings 68 of the receiving frameworks 64 of the frame 16, until the spring legs 22 of the actuating element 14 contact the supporting surfaces 20 of the receiving frameworks 64. In this condition, the circumferential edge of the head portion 20 of each actuating element 14 is received within the ribs 72 provided at the inner contour of the receiving frameworks 64. Thereafter, the push button caps 12 are pressed onto the receiving frameworks 64, such that the snap arms 62 of the push button caps 12 snap into the recesses 74 formed at opposite sides of the outer contour of each receiving framework 64. In this state the bottom face of the projection 46 of each push button cap 12 is in contact with the supporting surface 26 of the head portion 20 of the assigned actuating element 14, and the pins 28 of the actuating elements 14 are received within the assigned openings 50 provided at the bottom face 28 of each push button cap 12.

Thereafter, each push button cap 12 can be pressed down against the restoring force of its spring legs 40 as well as against the restoring force of the spring legs 22 of the actuating element 14. By pressing down the push button cap 12, the assigned actuating element 14 is also pressed down on the electronic switching element in order to effect a switching operation.

Due to the fact that the head portion 20 of each actuating element 14 is pressed in close contact with the bottom face of the projection 46 of the assigned push button cap 12 by means of the spring legs 22, each actuating element 14 is brought into a defined and stable position and no rattle will occur. Moreover, thanks to the uniform distribution of the spring legs 40 of each push button cap 12, an unwanted rocking of the push button cap 12 over its diagonal is prevented.

LIST OF REFERENCE NUMERALS

10 Push button switch assembly
12 Push button cap
14 Actuating element
16 Frame
18 Pin portion
20 Head portion
22 Spring legs
24 Groove
26 Supporting surface
28 Pin
30 Top face
32 Sidewall
34 Sidewall
36 Sidewall
38 Sidewall
40 Spring leg
42 Spring leg
43 Snap arm
44 Snap arm
46 Projection
48 Bottom face
50 Opening
52 Frame sidewall
54 Frame sidewall
56 Frame sidewall
58 Frame sidewall
60 Circumferential edge
62 Fixing means
64 Receiving frameworks
66 Connecting bar
68 Opening
70 Supporting surface
72 Rib
74 Recess

The invention claimed is:

1. Push button switch assembly for insertion in a control panel of a domestic appliance, the push button switch assembly comprising at least one push button having a push button cap and a separately formed actuating element, which extends between the push button cap and an electric switching element of the domestic appliance and upon actuating of the push button cap cooperates therewith and acts on the electric switching element to effect a switching operation, wherein the actuating element comprises a head portion and at least one spring leg arranged at the actuating element which counteracts the actuating of the push button cap, and a frame for receiving and guiding the actuating element, the frame having a support surface and two opposing ribs, wherein the spring leg contacts the support surface and the head portion is moveable between the two opposing ribs along a longitudinal axis of the actuating element.

2. Push button switch assembly according to claim 1, characterized in that the actuating element comprises at least two symmetrically and/or uniformly arranged spring legs.

3. Push button switch assembly according to claim 1, characterized in that the actuating element comprises a broadened head portion defining a supporting surface for the bottom side of the push button cap.

4. Push button switch assembly according to claim 1, characterized in that the push button cap comprises at least one spring leg, which counteracts the actuating of the push button cap.

5. Push button switch assembly according to claim 4, characterized in that a plurality of spring legs are provided at the push button cap, which are arranged in such a manner, that they counteract a tilting of the push button cap out of its plane, in particular out of its rest position plane or out of a plane parallel thereto.

6. Push button switch assembly according to claim 5, characterized in that the push button cap comprises at least three spring legs.

7. Push button switch assembly according to claim 5, characterized in that the push button cap comprises four symmetrically and uniformly arranged spring legs.

8. Push button switch assembly according to claim 1, characterized in that the frame has an inner contour comprising at least one boss and/or at least one rib, which are formed corresponding to assigned counter-contours of the at least one push button cap in order to define the position of the push button cap relative to the frame in the rest position of the push button cap and/or in order to guide the push button cap during an actuating of the push button cap relative to the frame.

9. Push button switch assembly according to claim 1, characterized in that the frame has an inner contour comprising at least one guiding structure, which is formed corresponding to an associated counter-contour of the at least one actuating element, in order to define the position of the actuating element relative to the frame in the rest-position of the push button cap and/or in order to guide the actuating element during an actuating of the push button cap relative to the frame.

10. Push button switch assembly according to claim 1, characterized in that the frame has an inner contour limiting an admissible actuating stroke of the actuating element with respect to the switching element of the domestic appliance.

11. Push button switch assembly according to claim 1, characterized in that the frame comprises a circumferential edge, which rests on the side of the control panel facing an operator.

12. Push button switch assembly according to claim 1, characterized in that the frame comprises fixing means for fixing the frame at the control panel.

13. Push button switch assembly according to claim 1, characterized in that the electric switching element of the domestic appliance is a switch arranged on a circuit board, in particular a micro switch.

14. Push button switch assembly for insertion in a control panel of a domestic appliance, the push button switch assembly comprising:

at least one push button having a push button cap provided with a first spring leg and a separately formed actuating element provided with a second spring leg, wherein the actuating element extends between the push button cap and an electric switching element of the domestic appliance and upon actuating of the push button cap cooperates therewith and acts on the electric switching element to effect a switching operation, and a frame for receiving and guiding the at least one push button, the frame having a first support surface and a second support surface for counteracting the actuation of the push button cap, wherein the first spring legs contact the first support surface, and the second spring legs contact the second support surface.

* * * * *